US009253563B2

(12) United States Patent
Fukuda

(10) Patent No.: US 9,253,563 B2
(45) Date of Patent: Feb. 2, 2016

(54) BONE CONDUCTION SPEAKER UNIT

(71) Applicant: TEMCO JAPAN CO., LTD., Tokyo (JP)

(72) Inventor: Mikio Fukuda, Tokyo (JP)

(73) Assignee: TEMCO JAPAN CO., LTD., Tokyo (JP)

( * ) Notice: Subject to any disclaimer, the term of this patent is extended or adjusted under 35 U.S.C. 154(b) by 0 days.

(21) Appl. No.: 14/364,135

(22) PCT Filed: Oct. 25, 2013

(86) PCT No.: PCT/JP2013/078995

§ 371 (c)(1),
(2) Date: Jun. 10, 2014

(87) PCT Pub. No.: WO2014/083986

PCT Pub. Date: Jun. 5, 2014

(65) Prior Publication Data

US 2015/0264473 A1 Sep. 17, 2015

(30) Foreign Application Priority Data

Nov. 27, 2012 (JP) ..... 2012-258684
Aug. 22, 2013 (JP) ..... 2013-172564

(51) Int. Cl.
*H04R 1/46* (2006.01)
*H04R 9/06* (2006.01)
*H04R 1/02* (2006.01)

(52) U.S. Cl.
CPC .. *H04R 1/46* (2013.01); *H04R 9/06* (2013.01); *H04R 1/025* (2013.01); *H04R 2460/13* (2013.01); *H04R 2499/11* (2013.01)

(58) Field of Classification Search
CPC ..... H04R 2460/13; H04R 1/1016
USPC ..... 381/151, 326, 380
See application file for complete search history.

(56) References Cited

U.S. PATENT DOCUMENTS

2006/0165246 A1* 7/2006 Lee et al. ..... H04B 1/385 381/151
2009/0041269 A1* 2/2009 Hemer ..... H04R 17/00 381/151
2010/0316235 A1* 12/2010 Park ..... H04R 1/025 381/151
2013/0329918 A1* 12/2013 Kubba ..... G02B 27/017 381/151

FOREIGN PATENT DOCUMENTS

JP 2007189578 A 7/2007
JP 2009302815 A 12/2009
WO 2007/034739 A1 3/2007
WO 2008/004273 A1 1/2008

OTHER PUBLICATIONS

International Search Report A; PCT/JP2013/078995; International Filing Date: Oct. 25, 2013; Temco Japan Co., Ltd.; 2 pgs.

* cited by examiner

*Primary Examiner* — Suhan Ni
(74) *Attorney, Agent, or Firm* — Schmeiser, Olsen & Watts, LLP

(57) ABSTRACT

Problem: To provide a bone conduction speaker unit which can sufficiently prevent generation of sound leakage at the time of non-calling, and can be easily incorporated in a main body casing of mobile phones, and the like.
Solution: A bone conduction speaker unit, being configured by incorporating a bone conduction speaker main body 2 in a housing 1, wherein an elastic plate 21 is fixed on a top face of a plate yoke 17 of the bone conduction speaker main body 2; an elastic base 22 is disposed on a rear face of a yoke 11; and an elastic cover 3 for holding a contact 5 which, upon a pressing force having been applied thereto in use, is abutted against the plate yoke 17 through the elastic plate 21 is loaded on the housing 1 with a gap "a" being held between a bottom face of the contact 5 and a top face of the elastic plate 21.

5 Claims, 2 Drawing Sheets

BONE CONDUCTION SPEAKER UNIT

TECHNICAL FIELD

The present invention relates to a bone conduction speaker unit, and more particularly, to a bone conduction speaker unit which, upon being incorporated in a mobile phone, or the like, will not present a problem of sound leakage.

BACKGROUND ART

The bone conduction speaker unit converts a voice signal into a vibration to transmit it to the skull, and the like, being compact and lightweight and capable of being used even under noise, whereby, in recent years, it has been widely used with communication apparatuses, such as a mobile phone, and the like.

In order to transmit a vibration of a diaphragm constituting the bone conduction speaker to the skull, a contact which is abutted against a side face of the head is fixed to the diaphragm, and for efficient transmission of the vibration of the diaphragm to this contact, the contact is fixed to the diaphragm (the plate yoke) in plane contact over a wide area (WO2005/069586A1, and the like). However, in that case, at the time of non-calling, in other words, also when the contact is not pressed against a side face of the head, the contact is vibrated together with bone conduction speaker being operated, thereby a voice vibration (an air conduction sound) being generated, and thus generation of a certain degree of sound leakage cannot be avoided, presenting a problem.

Then, as a configuration of a bone conduction speaker unit which, at the time of non-calling, can prevent generation of sound leakage and, at the time of calling, can exert the performance comparable to that of a conventional bone conduction speaker, there has been proposed a configuration which includes an accommodating section made of an elastic material, enclosing and supporting the whole of the bone conduction speaker therein, and a movable top face covering the top of the accommodating section and being disposed in contact with a diaphragm of the bone conduction speaker so as to be vibrated therewith, the movable top face having a projection formed on the inner face thereof, and only the projection being in contact with a plate yoke fixed to the vibration plate when the communication apparatus is not in use (Japanese Patent Publication No. 4369976).

For the bone conduction speaker related to this proposal, it has been confirmed that sound leakage is fairly reduced, but to a degree which cannot be said to be sufficient. In other words, the degree of reduction is not so high as to cause the leaked sound to be practically not heard when the ear is brought to near the bone conduction speaker, but to be loudly heard once the ear is pressed against it, thereby a distinct difference in loudness being perceived. In addition, matters, such as forming a projection on the inner face of the movable top face and adjusting the degree of contact with the plate yoke, present a problem of an increase in manufacturing cost.

CITATION LIST

Patent Literature

Patent Document 1: WO2005/069586A1

Patent Document 2: Japanese Patent Publication No. 4369976

DISCLOSURE OF THE INVENTION

Problems to be Solved by the Invention

As described above, with mobile phones, and the like, which use a conventional bone conduction speaker, the contact is always in tight contact with the plate yoke, thereby, even at the time of non-calling, when the contact is not abutted against a side face of the head, the contact being vibrated to generate a voice vibration, resulting in occurrence of sound leakage, which has been a problem. And, with the bone conduction speaker which has been conventionally proposed to solve this problem, it cannot be said that the reduction in sound leakage is sufficient, and there has been a problem of an increased manufacturing cost.

The present invention has been made to solve such problems, and it is an object of the present invention to provide a bone conduction speaker unit which, at the time of non-calling, can sufficiently prevent generation of sound leakage and, at the time of calling, can exert the performance comparable to that of a conventional bone conduction speaker, and which has a simple structure, allowing the manufacturing cost to be minimized, and can be easily incorporated in a main body casing of mobile phones, and the like.

Means for Solving the Problems

The invention to solve the above problems that is claimed in claim 1 is a bone conduction speaker unit, being configured by incorporating a bone conduction speaker main body in a housing, an elastic cover being mounted on a top face thereof, said bone conduction speaker main body being disposed in said housing through an elastic base, an elastic plate being fixed to a top face of a plate yoke of said bone conduction speaker main body, a contact being disposed on an internal top face of said elastic cover, upon said elastic cover having been mounted on said housing, a gap being held between a bottom face of said contact and the top face of the plate yoke of said bone conduction speaker main body, and upon a pressing force having been applied to said elastic cover in use, the bottom face of said contact being abutted against the elastic plate on the top face of said plate yoke.

In one embodiment, said contact is formed in a geometry having a flange in the upper portion thereof, being supported by a holding part in an annular shape that is provided on the internal top face of said elastic cover, seizing said flange for holding said contact such that the bottom face of said contact is exposed.

The invention to solve the above problems that is claimed in claim 4 is a bone conduction speaker unit, being configured by incorporating a bone conduction speaker main body in a housing, an elastic cover being mounted on a top face thereof, said bone conduction speaker main body being disposed in said housing through an elastic base, a thick-wall part being integrally formed on an internal top face of said elastic cover, upon said elastic cover having been mounted on said housing, a gap being held between a bottom face of said thick-wall part and a top face of the plate yoke of said bone conduction speaker main body, and upon a pressing force having been applied to said elastic cover in use, the bottom face of said thick-wall part being abutted against the top face of said plate yoke.

In another embodiment, a recessed part is formed in an inner bottom face of said housing, and with the whole of said recessed part being covered by said elastic base, a gap is formed under said elastic base.

Advantages of the Invention

The present invention is as described above, providing an advantage that, at the time of the bone conduction speaker unit being not in use, when no pressing force is applied to the elastic cover, a gap is always held between the bottom face of the contact and the top face of the elastic plate, or between the bottom face of the thick-wall part and the top face of the plate yoke, thereby it being reliably prevented that a vibration is unnecessarily transmitted to the elastic cover to cause generation of a voice vibration, resulting in sound leakage, and when in use, the elastic cover is pressed against a side face of the head, or the like, the contact or the thick-wall part which is supported by the elastic cover being pushed in toward the inside to be brought into plane contact with the plate yoke, thereby the vibration of the diaphragm being reliably transmitted to the elastic cover to cause the functions of the bone conduction speaker to be sufficiently exerted.

Further, the bone conduction speaker in accordance with the present invention is simple in construction, allowing the manufacturing cost to be held to a minimum, and yet is completed as an independent unit with minimized sound leakage, allowing it to be incorporated, as it is, in a casing of mobile phones, and the like.

BEST MODE FOR CARRYING OUT THE INVENTION

Figure 1:
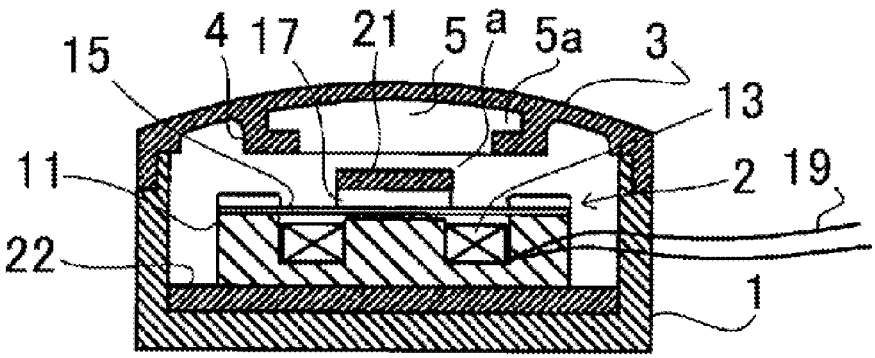
FIG. 1 is a longitudinal sectional view of a bone conduction speaker unit according to a first embodiment of the present invention.

Hereinbelow, embodiments of the present invention will be explained with reference to the accompanying drawings. FIG. 1 is a longitudinal sectional view of a bone conduction speaker unit according to a first embodiment of the present invention, and as shown in the same figure, the bone conduction speaker unit in accordance with the present invention includes a housing 1; a bone conduction speaker main body 2 incorporated in the housing 1; and an elastic cover 3 mounted on the housing 1.

Figure 4:
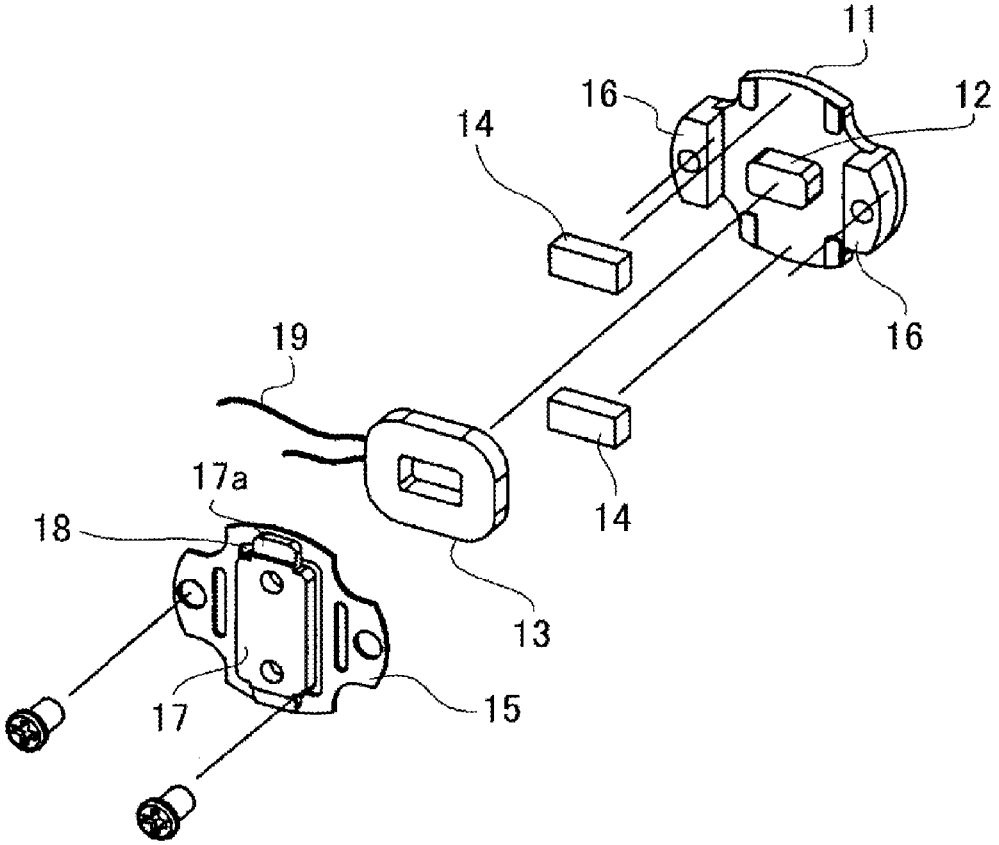
FIG. 4 is an exploded perspective view of a bone conduction speaker main body of the bone conduction speaker unit in accordance with the present invention.

The bone conduction speaker main body 2 is configured as shown in, for example, FIG. 4, with a voice coil 13 being disposed so as to surround a center pole 12 provided in the central portion of a yoke 11, a pair of bar-like magnets 14, 14 being fixed to both sides of the voice coil 13, and a diaphragm 15 being disposed so as to cover the voice coil 13 and the magnets 14, 14. The diaphragm 15 is fixed with both end parts thereof being screw-fastened to the top face of side walls 16 which are erected on both end parts of the yoke 11. At that time, a gap is provided between the diaphragm 15 and the top face of the voice coil 13 (see FIG. 1).

In the diaphragm 15, an opening 18 which corresponds to the plate yoke 17 is formed, and both end parts 17*a* in a longitudinal direction of the plate yoke 17, which extend beyond the opening 18, are fixed to the edge parts of the opening 18, thereby the plate yoke 17 being disposed so as to block the opening 18. Thus, the plate yoke 17 is vibrated along with the vibration of the diaphragm 15. The above embodiment provides a so-called outer shell configuration, in which the magnets 14, 14 are disposed outside of the voice coil 13, however, contrarily to such configuration, a so-called inner shell configuration, in which the magnet (also serving as the center pole) is disposed inside the voice coil, may be provided.

In the first embodiment of the present invention, an elastic plate 21 is fixed to the top face of the plate yoke 17 of the bone conduction speaker main body 2 configured as above, and on the rear face of the yoke 11, an elastic base 22 is disposed. The elastic base 22 is provided with a size which corresponds to the size of the inner bottom face of the housing 1 against which it is to be abutted. The elastic plate 21 and the elastic base 23 are manufactured by using, for example, a foamed material, such as urethane foam or acrylic foam, or a rubber material, having a low hardness, such as silicone rubber or urethane rubber.

The housing 1 is an accommodating element, generally made of a hard resin, and the elastic cover 3 is formed of a rubber material, having a low hardness, such as silicone rubber or urethane rubber, being connected to the housing 1. In the side wall of the housing 1, there is formed an opening for pulling out lead wires 19 extending from the voice coil 13. Further, in the internal top face of the elastic cover 3, there is formed a holding part 4 for a contact 5 which is to be abutted against the plate yoke 17 through the elastic plate 21. The contact 5 is formed in a geometry which has a flange 5*a* in the upper portion, and the holding part 4 is formed in an annular shape, seizing this flange 5*a*, and exposing the bottom face of the contact 5. The contact 5 can be tightly fitted to the inside of the holding part 4 by utilizing the elasticity of the holding part 4 to expand it.

The bone conduction speaker main body 2 is loaded into the housing 1 generally with the elastic base 22 having been previously fixed to the rear face of the yoke 11, and is disposed in the inside of the housing 1 by fixing the elastic base 22 to the inner bottom face of the housing 1. And then, the lead wires 19 extending from the voice coil 13 are pulled out from the opening provided in the side wall of the housing 1. Thereafter, the elastic cover 3 is fitted to the housing 1, however, at that time, a gap "a" is secured between the bottom face of the contact 5 and the elastic plate 21 on the plate yoke 17. This gap "a" is set to provide a distance which allows the bottom face of the contact 5 to be reliably brought into a tight contact with the elastic plate 21 when a certain degree of force is applied to the elastic cover 3, in other words, when, in use, the elastic cover 3 is pressed against a side face of the head, or the like, resulting in the elastic cover 3 being pushed in toward the inside.

The vibration output of the bone conduction speaker main body 2 is generated with a part of the bone conduction speaker main body 2 being contacted with the housing 1, and therefore, at the time of non-calling, the bone conduction speaker main body 2 is required to be held in a floated state in the housing 1 as much as possible in order to prevent from being brought into direct contact with the housing 1. However, with the bone conduction speaker unit configured as above, the bone conduction speaker main body 2 is fixed to the inner bottom face of the housing 1 through the elastic base 22 disposed on the rear face of the bone conduction speaker main body 2, and at the time of non-calling, the plate yoke 17 is supported, being separated from the contact 5 installed in the housing 1 through the elastic cover 3 by a distance of the gap "a", thereby an ideal configuration in which the entire bone conduction speaker main body 2 will not be directly contacted with the housing 1 being provided.

Figure 2:
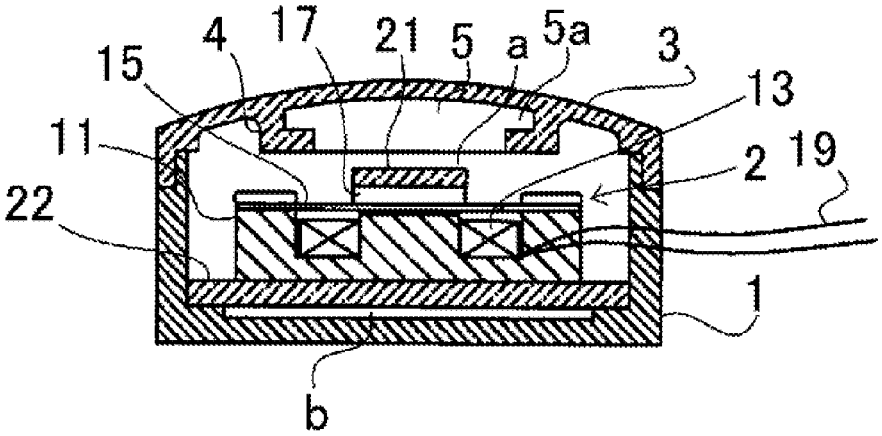
FIG. 2 is a longitudinal sectional view of a bone conduction speaker unit according to a variation of the first embodiment of the present invention.

The yoke 11 is a portion which is difficult to transmit a vibration, as compared to the vibration system portion, in other words, the portion consisting of the diaphragm 15 and the plate yoke 17 fixed thereto, and thus, as in the first embodiment shown in FIG. 1, simply by disposing the yoke 11 with the elastic base 22 being interposed between it and the inner bottom face of the housing 1, a sufficient isolation from the housing 1 is provided, however, this isolation effect is further enhanced with a variation shown in FIG. 2.

In other words, with that variation, a shallow recessed part 6 is formed in the inner bottom face of the housing 1, the entire recessed part 6 being covered by the elastic base 22, and the other components are configured in the same manner as in the above embodiment. With this variation of the first embodiment, the peripheral edge part of the bottom face of the elastic base 22, which is disposed on the rear face of the yoke 11, is fixed to the peripheral bank part of the recessed part 6, thereby, under the elastic base 22, a gap "b" being formed which is to be hermetically sealed by the elastic base 22.

If the gap "b" is provided under the elastic base 22 in this way, the degree of contact of the bone conduction speaker main body 2 with the housing 1 is further reduced to enhance the isolation effect, thereby a structure with which, at the time of non-calling, the vibration output of the bone conduction speaker main body 2 is more difficult to be transmitted to the housing 1 being provided.

With the above bone conduction speaker unit, at the time of non-calling, when a pressing force is not applied to the elastic cover 3, the plate yoke 17 and the elastic plate 21 on the top face thereof is separated from the contact 5 by a distance of the gap "a", and therefore, even if the plate yoke 17 and the elastic plate 21 are vibrated, the vibration will not be transmitted to the contact 5, thereby unintended sound leakage being prevented from being caused.

And, at the time of calling, if the elastic cover 3 is pressed against a side face of the head, or the like, the elastic cover 3 is pushed in toward the inside, thereby the bottom face of the contact 5 being brought into plane contact with the plate yoke 17 through the elastic plate 21. In this state, upon a vibration being generated by a voice signal, the vibration is transmitted to the contact 5 through the plate yoke 17 and the elastic plate 21, and transmitted from the contact 5 to the skull, thus a bone conduction speech reception being made possible. At that time, the elastic plate 21 is interposed between the plate yoke 17 and the contact 5, thereby the possibility of occurrence of an event in which the plate yoke 17 and the contact 5 are contacted with each other, resulting in an abnormal noise being generated, being eliminated.

Figure 3:
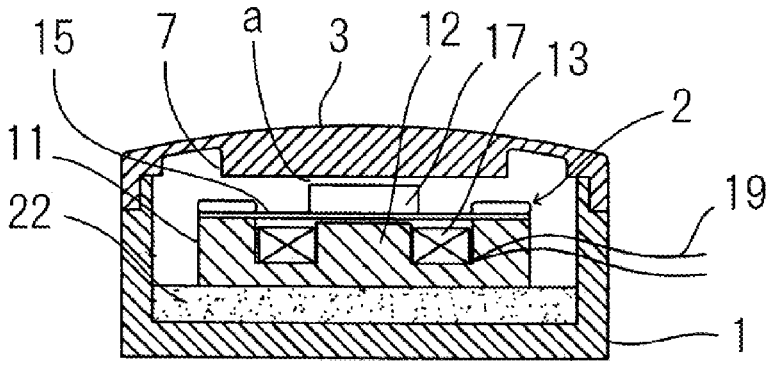
FIG. 3 is a longitudinal sectional view of a bone conduction speaker unit according to a second embodiment of the present invention.

FIG. 3 shows a second embodiment of the present invention, which is the same as the above first embodiment in that there is provided a bone conduction speaker unit configured by incorporating the bone conduction speaker main body 2 in the housing 1 on the top face of which the elastic cover 3 is to be mounted, wherein the bone conduction speaker main body 2 is disposed in the housing 1 through the elastic base 22, and the second embodiment may be configured as a variation thereof such that it provides the same recessed part 6 as that shown in FIG. 2.

In this second embodiment, the above contact 5 is not used, and instead of it, a thick-wall part 7, the bottom face of which is flat, is integrally formed on the internal top face of the elastic cover 3, and upon the elastic cover 3 being mounted on the housing 1, a gap "a" is held between the bottom face of the thick-wall part 7 and the top face of the plate yoke 17 of the bone conduction speaker main body 2.

Also with this bone conduction speaker unit according to the second embodiment, at the time of non-calling, when a pressing force is not applied to the elastic cover 3, the plate yoke 17 is separated from the thick-wall part 7 by a distance of the gap "a", and therefore, even if the plate yoke 17 is vibrated, the vibration will not be transmitted to the thick-wall part 7, in other words, the elastic cover 3, thereby an unintended sound being prevented from being generated. Further, at the time of calling, if the elastic cover 3 is pushed in toward the inside, the bottom face of the thick-wall part 7 is brought into plane contact with the plate yoke 17, and in this state, if a vibration is generated by a voice signal, the vibration is transmitted from the plate yoke 17 to the skull through the thick-wall part 7, thus a bone conduction speech reception being made possible. And, since the thick-wall part 7 is made of an elastic material, there is no possibility of that the plate yoke 17 and the thick-wall part 7 are contacted with each other, resulting in an abnormal noise being generated.

The bone conduction speaker unit in accordance with the present invention is configured as above, being completed as an independent unit with minimized sound leakage, and thus can be used, being incorporated, as it is, in a main body casing of mobile phones, and the like, by an optional method of mounting, and providing excellent usability. In addition, a gap "a" is secured between the plate yoke 17 (the elastic plate 21) and the contact 5 (the thick-wall part 7), whereby sound leakage can be reliably prevented. Further, since the bone conduction speaker main body 2 is loaded in the housing 1 to which the elastic cover 3 is tightly fitted, whereby there is no need for separately taking measures against moisture and dust.

Hereinabove, the present invention has been explained in detail to some extent, and about the most preferred embodiment, however, since it is obvious that a wide range of different embodiments can be made without departing from the spirit and scope of the present invention, it is to be understood that the present invention is not limited to the specific embodiments thereof except as defined in the appended claims.

The invention claimed is:

1. A bone conduction speaker unit comprising:

a bone conduction speaker main body in a housing;

an elastic cover being mounted on a top face thereof, said bone conduction speaker main body being disposed in said housing through an elastic base;

an elastic plate being fixed to a top face of a plate yoke of said bone conduction speaker main body; and a contact being disposed on an internal top face of said elastic cover;

wherein upon said elastic cover having been mounted on said housing, a gap being held between a bottom face of said contact and the top face of the plate yoke of said bone conduction speaker main body, wherein upon a pressing force having been applied to said elastic cover in use, the bottom face of said contact being abutted against the elastic plate on the top face of said plate yoke.

2. The bone conduction speaker unit according to claim 1, wherein a recessed part is formed in an inner bottom face of said housing, and with the whole of said recessed part being covered by said elastic base, a gap is formed under said elastic base.

3. The bone conduction speaker unit according to claim 1, wherein said contact is formed in a geometry having a flange in the upper portion thereof, being supported by a holding part in an annular shape that is provided on the internal top face of said elastic cover, seizing said flange for holding said contact such that the bottom face of said contact is exposed.

4. A bone conduction speaker unit comprising a bone conduction speaker main body in a housing, an elastic cover being mounted on a top face thereof, said bone conduction speaker main body being disposed in said housing through an elastic base; and a thick-wall part being integrally formed on an internal top face of said elastic cover;

wherein upon said elastic cover having been mounted on said housing, a gap being held between a bottom face of said thick-wall part and a top face of the plate yoke of said bone conduction speaker main body;

wherein upon a pressing force having been applied to said elastic cover in use, the bottom face of said thick-wall part being abutted against the top face of said plate yoke.

5. The bone conduction speaker unit according to claim 4, wherein a recessed part is formed in an inner bottom face of said housing, and with the whole of said recessed part being covered by said elastic base, a gap is formed under said elastic base.

* * * * *